United States Patent [19]

Ito

[11] 4,195,988

[45] Apr. 1, 1980

[54] AU-PD-CR ALLOY FOR SPARK PLUG ELECTRODES

[75] Inventor: Tsuneo Ito, Nagoya, Japan

[73] Assignee: NGK Spark Plug Co., Ltd., Nagoya, Japan

[21] Appl. No.: 943,497

[22] Filed: Sep. 18, 1978

[30] Foreign Application Priority Data

Sep. 16, 1977 [JP] Japan ..... 52-111910

[51] Int. Cl.[2] ..... C22C 5/00

[52] U.S. Cl. ..... 75/165; 75/134 N; 75/172 G

[58] Field of Search ..... 75/165, 172, 134 N

[56] References Cited

U.S. PATENT DOCUMENTS

| | | | |
|---|---|---|---|
| 3,148,053 | 9/1964 | Spaletta | 75/134 |
| 3,406,673 | 10/1968 | Oster | 123/169 |
| 3,577,233 | 5/1971 | Gamor | 75/134 F |

*Primary Examiner*—L. Dewayne Rutledge
*Assistant Examiner*—Upendra Roy
*Attorney, Agent, or Firm*—Sughrue, Rothwell, Mion, Zinn and Macpeak

[57] ABSTRACT

An alloy for spark plug center electrodes comprising about 1 to about 10% by weight of chromium, about 30 to about 70% by weight of palladium and the balance gold.

4 Claims, 9 Drawing Figures

AU-PD-CR ALLOY FOR SPARK PLUG ELECTRODES

BACKGROUND OF THE INVENTION

1. Field of the Invention

This invention relates to an alloy for spark plug center electrodes. More particularly, it relates to an alloy for spark plug center electrodes having an improved heat resistance and resistance to the effects of lead (hereinafter "lead resistance").

2. Description of the Prior Art

Spark plugs in which the tip of the electrode is thinly formed to improve the sparking properties are known. Noble metal alloys, such as gold-palladium alloys and gold, palladium and silver alloys, are known as described in U.S. Pat. Nos. 1,296,938 and 1,339,505. Specifically, noble metal alloys, such as a platinum-tungsten alloy, a platinum-iridium alloy or a gold-palladium alloy, are used as materials for the center electrode of these spark plugs to prevent the electrode from wearing and to improve the durability of the plugs. Of these, a gold-palladium alloy is most commonly used since it is less expensive in comparison with the two platinum-containing alloys described above. However, although a gold-palladium alloy has the advantage that less deterioration as a material for spark plug center electrode under an oxidative atmosphere at high temperature occurs, there are the disadvantages that a gold-palladium alloy has poor corrosion resistance due to cinders of a leaded fuel which are generated upon use of a leaded gasoline and, when exposed to high temperatures, the crystals of a gold-palladium alloy coarsen and the strength and hardness of the gold-palladium alloy is reduced whereby the gold-palladium tends to wear.

SUMMARY OF THE INVENTION

It has now been found that chromium is particularly excellent as a metal element to be added to a gold-palladium alloy containing about 30 to about 70 wt% of palladium which is used as a material for a spark plug center electrode, and that the addition of chromium serves to remarkably improve the lead resistance and the heat resistance of the center electrode and reduce wearing of the center electrode due to sparks discharged.

Accordingly, an object of the present invention is to provide an alloy for spark plug center electrodes, which has excellent lead resistance and sufficient durability even when employed in an engine using leaded gasoline and wherein the crystals thereof do not coarsen even when exposed to high temperatures resulting in the heat resistance being remarkably improved.

Accordingly, the present invention provides an alloy comprising about 1 to about 10% by weight of chromium, about 30 to 70% by weight of palladium and the balance gold.

DETAILED DESCRIPTION OF THE INVENTION

The amount of chromium which can be used in the alloy of the present invention generally ranges from about 1 to about 10% by weight. If the amount of chromium is less than about 1% by weight, the degree of improvement in lead resistance and heat resistance is insufficient, whereas if the amount of chromium is more than about 10% by weight, the workability of the alloy becomes so poor that welding becomes difficult, although excellent lead resistance and heat resistance are attained.

A preferred amount of chromium which can be used in the alloy of the present invention ranges from about 4 to about 7% by weight, a preferred amount of palladium which can be used in the alloy of the present invention ranges from about 40 to about 60% by weight, and a preferred amount of gold which can be used in the alloy of the present invention ranges from about 33 to about 56% by weight.

The alloy of the present invention can be produced by melting a mixture of palladium and chromium in vacuo and then adding gold to the molten mixture. The starting material chromium, palladium and gold used to produce the alloy of this invention preferably has a degree of purity of about 99.8% by weight or more, about 99.9% by weight or more and about 99.9% by weight or more, respectively.

The alloy of this invention comprising about 1 to about 10% by weight of chromium has the following properties, in general.

| | |
|---|---|
| Mechanical Strength | 80–120 Kg/mm$^2$ |
| Hardness | 220–300 Hv |

Whereas a conventional gold-palladium alloy (50:50 weight ratio) not containing any chromium has the following properties.

| | |
|---|---|
| Mechanical Strength | 70 kg/mm$^2$ |
| Hardness | 200 Hv |

Thus, it can be seen that the presence of about 1 to about 10% by weight of chromium markedly improves the mechanical strength and hardness of the alloy of this invention.

Experimental results showing the lead resistance, the heat resistance and the wear resistance of the above-described gold-palladium-chromium alloy are given below.

Figure 1:
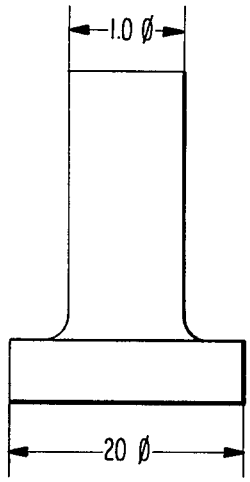
FIG. 1 is a front view of a test piece.

Test Pieces A, B, C, D, E and F having the alloy compositions as shown in the Table below were prepared. Each of the alloys was processed into a wire having a diameter of 2 mm. The tip portion of the wire was further cut so as to have a diameter of 1 mm as shown in FIG. 1 to produce a shape corresponding to a spark plug center electrode tip. Each of these was immersed in molten lead under each of the conditions of (i) 500° C., 30 sec, (ii) 650° C., 10 sec, and (iii) 650° C., 30 sec. The corrosion condition of each test piece is shown in FIG. 2 (*a*) to (*c*).

Table

| Component | Test Piece (% by weight) | | | | | |
|---|---|---|---|---|---|---|
| | A | B | C | D | E | F |
| Gold | 50 | 49 | 46 | 43 | 40 | 50 |
| Palladium | 50 | 50 | 50 | 50 | 50 | 40 |
| Chromium | 0 | 1 | 4 | 7 | 10 | 10 |

Figure 2:
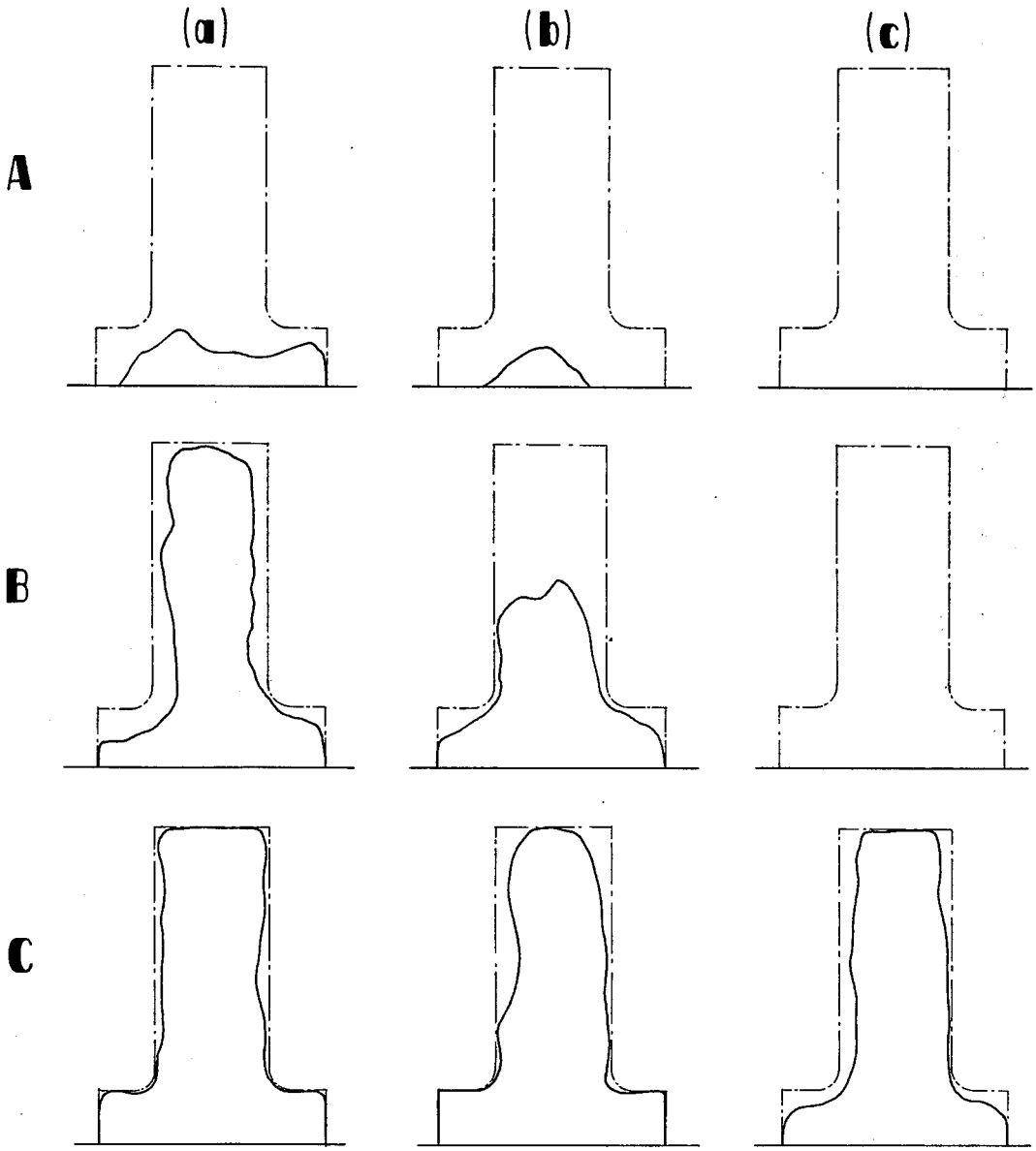
FIG. 2 (*a*) to (*c*) are illustrations showing the corroded condition of test pieces subjected to lead resistance testing.
Figure 2:
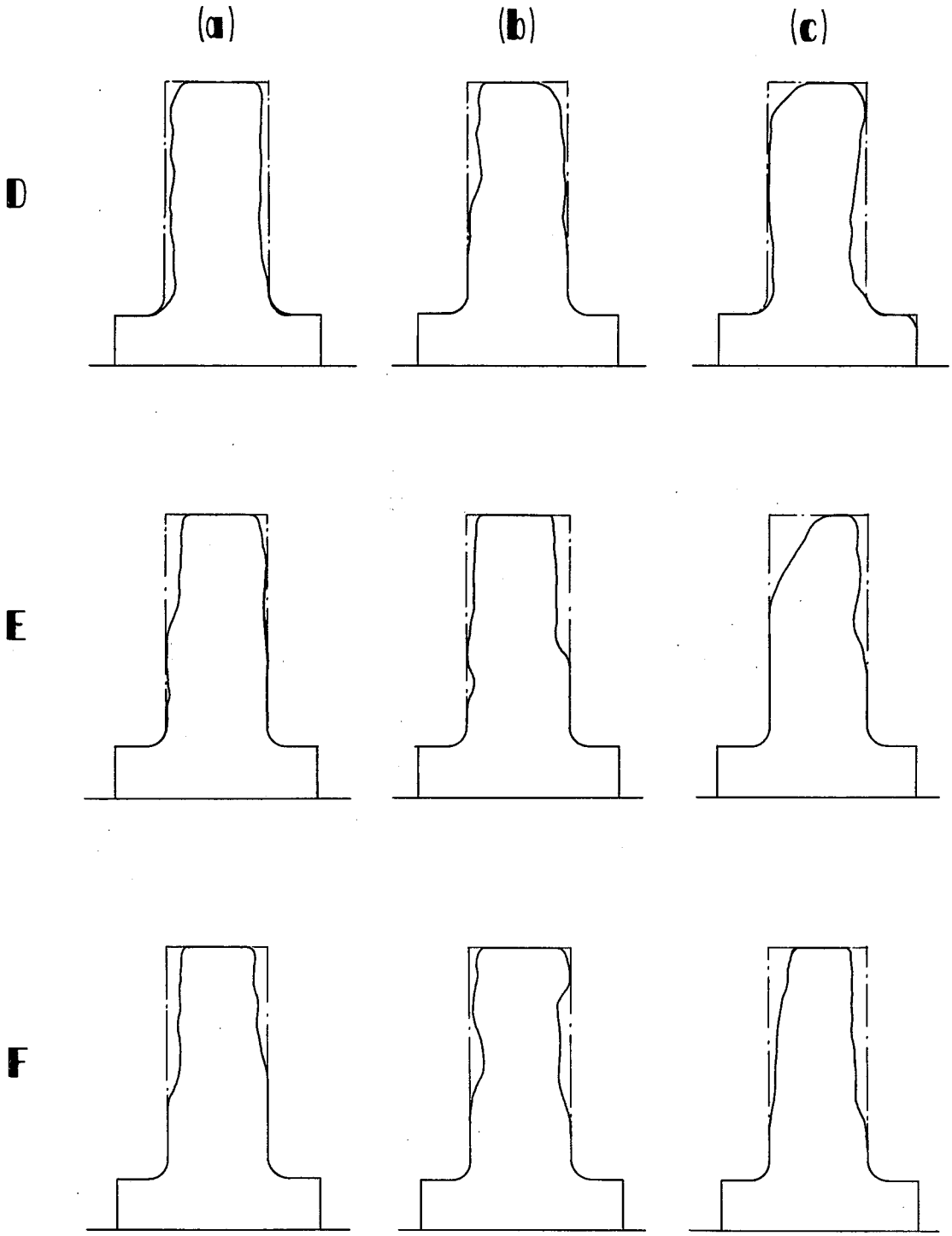
Figure 3A:
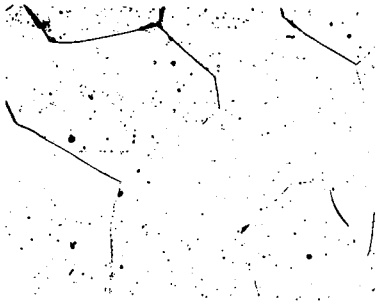
FIG. 3A to FIG. 3F are photographs showing cross-sectional views of the metal structure of test pieces subjected to heat resistance testing.
Figure 3B:
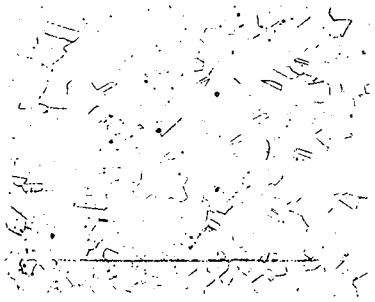
Figure 3C:
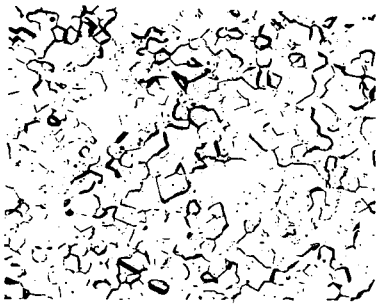
Figure 3D:
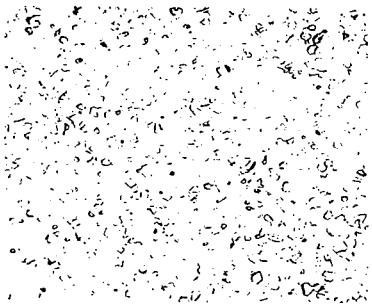
Figure 3E:
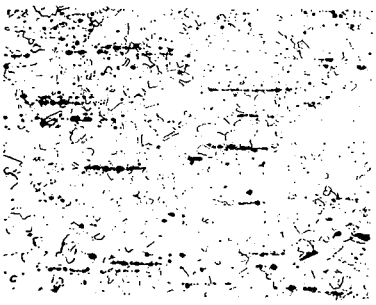
Figure 3F:
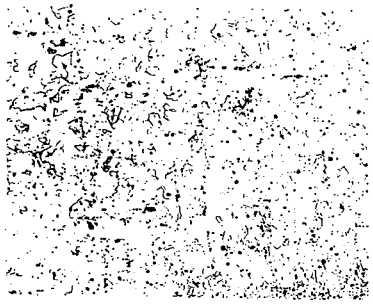

From the above-described evaluations conducted under the conditions of (i), (ii) and (iii) which were established by considering the condition of the adhesion of leaded gasoline cinders to the center electrode tip at the center electrode tip temperature upon spark plugs in an engine, it can be seen that conventional Test Piece A of the gold-palladium alloy which did not contain chromium was almost completely corroded away in conditions (i), (ii) and (iii) as shown in FIG. 2, whereas chromium-containing alloy Test Pieces B, C, D, E and F were corroded less and exhibited more lead resistance as the amount of chromium increased.

Cross-sectional microphotographs (degree of magnification: 100) of Test Pieces A, B, C, D, E and F after allowing them to stand for hours at 1,000° C. in air are shown in FIG. 3.

As can be seen from these cross-sectional photographs in FIG. 3, serious coarsening of the crystals in the alloy of Test Piece A which did not contain chromium occurred when it was allowed to stand in air at 1,000° C., which is the upper limit of the temperature of the center electrode tip of a spark plug in an engine, whereas less coarsening of the crystals of the chromium-containing alloy of Test Pieces B, C, D, E and F occurred, with the effect in preventing coarsening increasing as the amount of chromium increased.

Thus, since the crystals of the alloy were maintained fine as described above, less reduction in mechanical strength and hardness of the chromium-containing alloy test pieces occurred and improved high temperature strength and excellent heat resistance were obtained.

Figure 4:
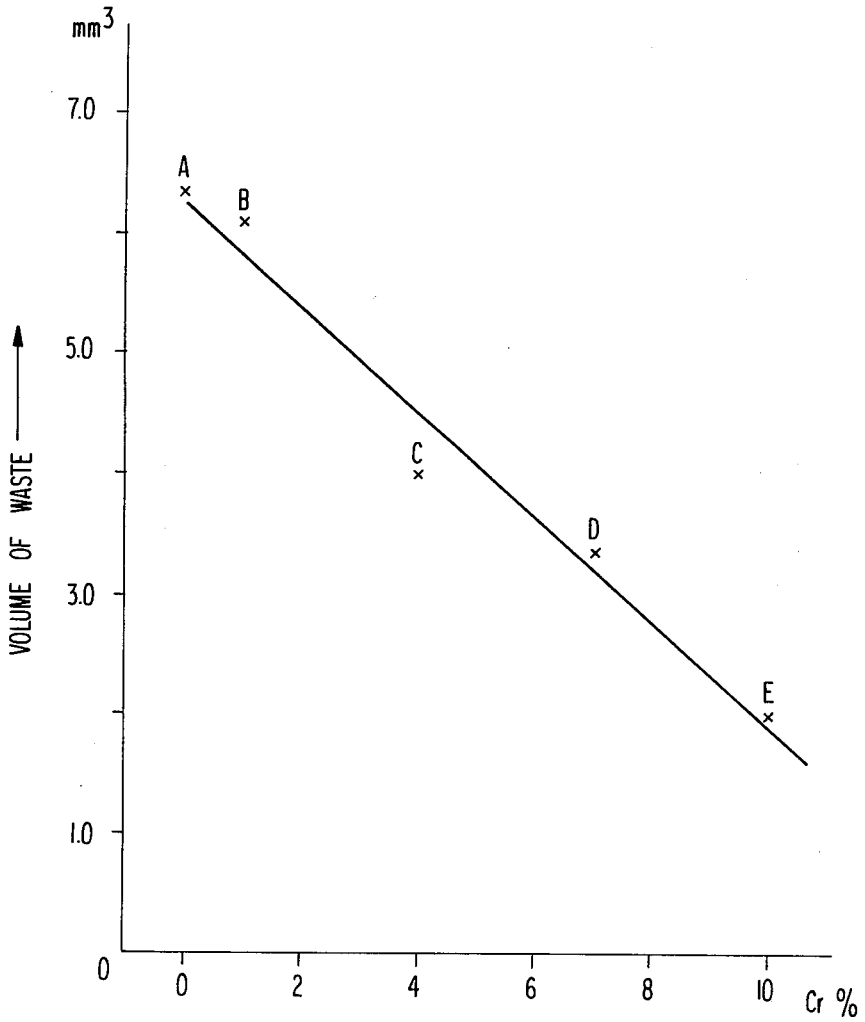
FIG. 4 is a graph showing the results of wear resistance testing.

FIG. 4 is a graph showing the amount of the alloy worn away or volume of waste of each of Test Pieces A, B, C, D, and E after wear resistance tests in which each test piece was used as an electrode end and spark discharge was conducted continuously for 120 minutes with a discharge gap of 20 mm using a neon transformer.

As is shown by the graph of FIG. 4, the volume of waste of the test pieces decreased as the amount of chromium increased and, with Test Piece E containing 10% by weight of chromium, the volume of waste was reduced to $\frac{1}{3}$ of that of the conventional gold-palladium alloy test piece. Thus, wear resistance was markedly improved.

As is described above, the gold-palladium-chromium alloy of the present invention shows a remarkably excellent lead resistance, heat resistance and wear resistance due to the addition of chromium, and is extremely excellent as an alloy for spark plug center electrodes.

While the invention has been described in detail and with reference to specific embodiments thereof, it will be apparent to one skilled in the art that various changes and modifications can be made therein without departing from the spirit and scope thereof.

What is claimed is:

1. An alloy for spark plug center electrodes consisting of about 1 to about 10% by weight of chromium, about 30 to about 70% by weight of palladium and the balance gold..

2. The alloy of claim 1, wherein said alloy comprises about 4 to about 7% by weight of chromium, about 40 to about 60% by weight of palladium and about 33 to about 56% by weight of gold.

3. A method of improving the lead resistance and heat resistance of a gold-palladium alloy used as a spark plug center electrode which comprises incorporating chromium into said palladium-gold alloy such that said alloy consists of about 1 to about 10% by weight of chromium, about 30 to about 70% by weight of palladium and the balance gold..

4. The method of claim 3, wherein the incorporating of the chromium is such that said alloy comprises about 4 to about 7% by weight of chromium, about 40 to about 60% by weight of palladium and about 33 to about 56% by weight of gold.

* * * * *